US009777355B2

(12) United States Patent
Sato et al.

(10) Patent No.: US 9,777,355 B2
(45) Date of Patent: Oct. 3, 2017

(54) PROCESS FOR PRODUCING PRECIPITATION STRENGTHENING MARTENSITIC STEEL

(71) Applicant: HITACHI METALS, LTD., Tokyo (JP)

(72) Inventors: Jun Sato, Shimane (JP); Tomonori Ueno, Shimane (JP); Eiji Shimohira, Shimane (JP)

(73) Assignee: HITACHI METALS, LTD., Tokyo (JP)

( * ) Notice: Subject to any disclaimer, the term of this patent is extended or adjusted under 35 U.S.C. 154(b) by 317 days.

(21) Appl. No.: 14/402,180

(22) PCT Filed: Sep. 19, 2013

(86) PCT No.: PCT/JP2013/075301
§ 371 (c)(1),
(2) Date: Nov. 19, 2014

(87) PCT Pub. No.: WO2014/050698
PCT Pub. Date: Apr. 3, 2014

(65) Prior Publication Data

US 2015/0299831 A1 Oct. 22, 2015

(30) Foreign Application Priority Data

Sep. 27, 2012 (JP) ..... 2012-214944

(51) Int. Cl.
*C21D 6/02* (2006.01)
*C22C 38/50* (2006.01)
(Continued)

(52) U.S. Cl.
CPC ..... *C22C 38/50* (2013.01); *C21D 6/004* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS 3,342,590 A 9/1967 Bieber
3,658,513 A 4/1972 Clarke, Jr.
(Continued)

FOREIGN PATENT DOCUMENTS

EP 1584699 A1 10/2005
EP 1669473 A1 6/2006
(Continued)

OTHER PUBLICATIONS

Machine-English translation of JP2012-167346, Miura Kensuke et al., Sep. 6, 2012.*
(Continued)

*Primary Examiner* — Deborah Yee
(74) *Attorney, Agent, or Firm* — Rankin, Hill & Clark LLP

(57) ABSTRACT

There are provided a precipitation strengthening type martensitic steel having both a tensile strength of a 1500 MPa class and a high Charpy absorption energy of 30 J or higher, and a manufacturing process thereof. The precipitation strengthening type martensitic steel includes, in terms of mass %, 0.05% or less of C, 0.2% or less of Si, 0.4% or less of Mn, 7.5 to 11.0% of Ni, 10.5 to 13.5% of Cr, 1.75 to 2.5% of Mo, 0.9 to 2.0% of Al, less than 0.1% of Ti, and a remainder of Fe and impurities, and contains 0.1 to 6.0% of austenite in terms of a volume fraction.

8 Claims, 2 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/44*** | (2006.01) |
| ***C21D 6/00*** | (2006.01) |

(52) U.S. Cl.

CPC ..... *C21D 6/02* (2013.01); *C22C 38/02* (2013.01); *C22C 38/04* (2013.01); *C22C 38/06* (2013.01); *C22C 38/44* (2013.01); *C21D 2211/001* (2013.01); *C21D 2211/004* (2013.01); *C21D 2211/008* (2013.01)

(56) References Cited

U.S. PATENT DOCUMENTS

| | | | |
|---|---|---|---|
| 5,681,528 | A | 10/1997 | Kosa |
| 5,888,449 | A | 3/1999 | Kennedy |
| 2003/0217789 | A1 | 11/2003 | Kondo |
| 2005/0126662 | A1 | 6/2005 | Cao |
| 2005/0130559 | A1 | 6/2005 | Falla |
| 2005/0224143 | A1 | 10/2005 | Ueda |
| 2006/0118215 | A1 | 6/2006 | Hirakawa et al. |
| 2011/0255988 | A1 | 10/2011 | Oikawa |
| 2012/0114496 | A1 | 5/2012 | Oikawa |
| 2015/0315921 | A1 | 11/2015 | Ooyama |

FOREIGN PATENT DOCUMENTS

| | | | | |
|---|---|---|---|---|
| EP | 2377962 | A1 | | 10/2011 |
| EP | 2455496 | A1 | | 5/2012 |
| JP | 07-258729 | | | 10/1995 |
| JP | 2005-194626 | | | 7/2005 |
| JP | 2012-167346 | | * | 9/2012 |
| JP | 2013-241670 | | | 12/2013 |
| WO | 2005078149 | A1 | | 8/2005 |

OTHER PUBLICATIONS

"Steel, Corrosion-Resistant, Bars, Wire, Forgings, Rings, and Extrusions 13Cr—8.0Ni—2.2Mo—1.1Al Vacuum Induction Plus Consumable Electrode Melted Solution Heat Treated, Precipitation Hardenable", SAE International, Oct. 31, 2006, pp. 1-11.; Cited in Chinese Office Action issued on Jun. 9, 2015 for the corresponding Chinese Patent Application No. 201380024235.8.

International Search Report dated Nov. 5, 2013 filed in PCT/JP2013/075301.

Extended European Search Report issued on May 20, 2016 for the corresponding European Patent Application No. 13842588.9.

Japanese Office Action dated Mar. 20, 2014 issued in the corresponding Japanese patent application No. 2013-552657.

* cited by examiner

PROCESS FOR PRODUCING PRECIPITATION STRENGTHENING MARTENSITIC STEEL

TECHNICAL FIELD

The present invention relates to a precipitation strengthening type martensitic steel having high strength and excellent impact properties, and to a process for producing the same.

BACKGROUND ART

Heretofore, high-strength iron-based alloys have been used as power generation turbine components and aircraft body components.

In the power generation turbine components, high Cr steel is used for various kinds of the components. Among the turbine components, a low-pressure final-stage rotor blade of a steam turbine should be particularly strengthened. Thus, in this component, stainless steel containing approximately 12 weight % of Cr, 12-Cr steel, is used as an alloy having combined properties of strength, oxidation resistance, and corrosion resistance. Among them, furthermore, the blade having a longer blade length is advantageous to improve power generation efficiency. However, the length of the 12-Cr steel blade is limited up to about 1 meter because of its limited strength.

Also, there are known low alloy high tensile steels such as AISI4340 and 300M. These alloys are low-alloy steel capable of attaining a tensile strength in the order of 1800 MPa and an elongation of about 10%. In these alloys, however, the amount of Cr, which contributes to corrosion resistance and oxidation resistance, is as small as approximately 1%. Therefore, any of these alloys cannot be used as a steam turbine rotor blade. When applied to an aircraft application, these are also often subjected to surface treatment such as plating before use to prevent corrosion from salt or the like in the air.

On the other hand, as an alloy having combined properties of strength, corrosion resistance and oxidation resistance, there is a high strength stainless steel. Representative examples of the strengthening type martensitic steel known in the art include precipitation strengthening type martensitic steel such as PH13-8Mo (Patent Document 1 and Patent Document 2). The precipitation strengthening type martensitic steel, fine precipitates are dispersed and precipitated in a quenched martensite structure to obtain higher strength compared to quenching-tempering type 12-Cr steel. Furthermore, compared with the low-alloy steel, these are excellent in properties of corrosion resistance and oxidation resistance because of containing 10% or more of Cr that contributes to corrosion resistance.

CITATION LIST

Patent Literature

Patent Document 1: JP-A-2005-194626
Patent Document 2: U.S. Pat. No. 3,342,590

SUMMARY OF INVENTION

Problems to be Solved by the Invention

In the precipitation strengthening type martensitic steel described in the above-described Patent Document 1 or Patent Document 2, dispersion of a large amount of fine precipitates, which contribute to strength, tends to give an alloy with higher strength, while causing a decrease in toughness thereof. For example, when considering the application of the precipitation strengthening type martensitic steel to the elongation and enlargement of steam turbine rotor blades or the application to aircraft uses, the steel may desirably have a tensile strength of 1500 MPa or higher, but leaving a problem in balancing between strength and toughness.

For example. Patent Document 1 discloses the invention of a steam turbine blade material in which ingredients are limited to achieve both tensile strength and toughness, and furthermore describes an absorption energy of 20 J or higher in the Charpy impact test as an evaluation criteria of toughness. However, since the absorption energies of a 12-Cr steel and a low alloy-based high tensile steel are 30 J or higher, there is a strong demand for an alloy having an absorption energy equivalent to that of the traditional materials.

An object of the present invention is to provide a precipitation strengthening type martensitic steel having both a tensile strength of a 1500 MPa class and a high Charpy absorption energy of 30 J or higher, and to a manufacturing process thereof.

Solutions to the Problems

In order to balance between strength properties and toughness of the precipitation strengthening type martensitic steel, the present inventors intensively studied the correlations between mechanical properties and structures for various alloys. As a result, it was found that controlling the amount of a retained austenite phase after solution treatment within an appropriate range enables the tensile strength and the high Charpy absorption energy after heat treatment to be balanced.

Specifically, in a precipitation strengthening type martensitic steel according to the present invention including, in terms of mass %, 0.05% or less of C, 0.2% or less of Si, 0.4% or less of Mn, 7.5 to 11.0% of Ni, 10.5 to 13.5% of Cr, 1.75 to 2.5% of Mo, 0.9 to 2.0% of Al, less than 0.1% of Ti, and a remainder of Fe and impurities, a content of an austenite is 0.1 to 6.0% in terms of a volume fraction.

In this precipitation strengthening type martensitic steel, the austenite preferably has a volume fraction of 0.3 to 6.0%.

In addition, in a process for producing a precipitation strengthening type martensitic steel according to the present invention including, in terms of mass %, 0.05% or less of C, 0.2% or less of Si, 0.4% or less of Mn, 7.5 to 11.0% of Ni, 10.5 to 13.5% of Cr, 1.75 to 2.5% of Mo, 0.9 to 2.0% of Al, less than 0.1% of Ti, and a remainder of Fe and impurities, the process includes subjecting a precipitation strengthening type martensitic steel containing 0.1 to 5.0% of austenite in terms of a volume fraction to an aging treatment to provide the austenite with a volume fraction of 0.1 to 6.0%.

Effects of the Invention

The precipitation strengthening type martensitic steel according to the present invention has both high strength and excellent toughness. Therefore, when the martensitic steel is used in power generation turbine components, power generation efficiency can be expected to improve. Also, the use of the martensitic steel as aircraft components enables contribution to weight reduction of aircraft bodies.

DESCRIPTION OF EMBODIMENTS

Figure 1:
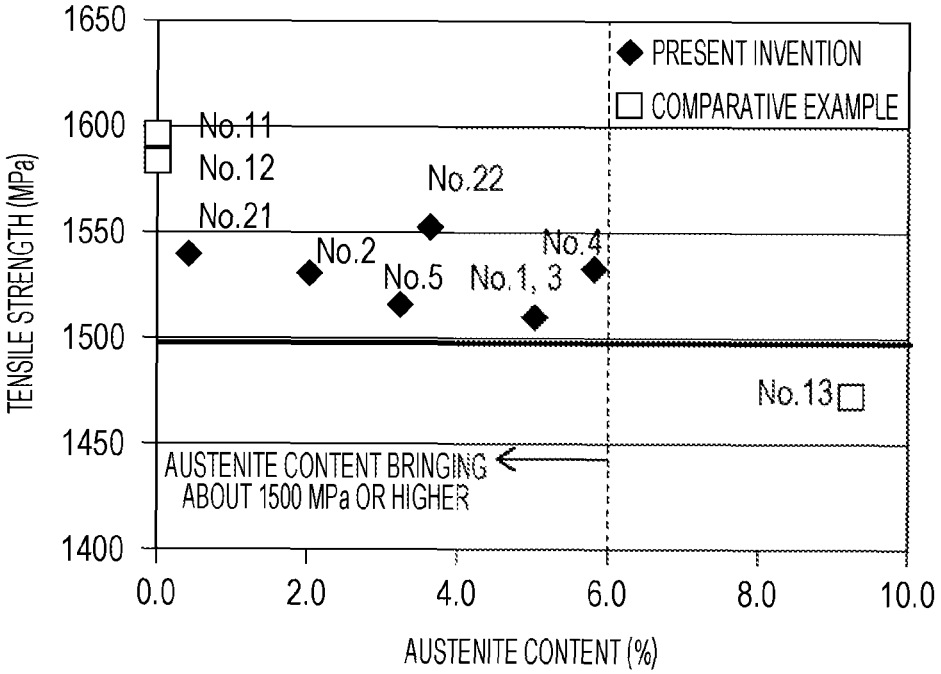
FIG. 1 is a diagram illustrating the correlation between a tensile strength and an austenite content.

As described above, the main feature of the present invention is that the amount of an austenite phase after heat treatment is controlled within an appropriate range to balance between a tensile strength and a high Charpy absorption energy.

First, the reason of a limited austenite volume fraction, which is the most distinguishing feature of the present invention will be described below.

Volume Fraction of Austenite: 0.1 to 6.0%

The precipitation strengthening martensitic steel has at least two stages of a heat treatment process. The first heat treatment is a solution treatment (ST), and the second heat treatment is an aging treatment (Ag). After the solution treatment, a part of an austenite phase is sometimes not transformed, and remains, depending on alloy ingredients and heat treatment conditions. This is called retained austenite, which has been considered to cause reduction of strength and to be desirably decreased. An alloy containing an added element in a large amount for the purpose of increasing strength has a low martensitic transformation temperature. Accordingly, in such an alloy, the retained austenite is likely to occur. Therefore, treatment (sub-zero treatment) is sometimes employed in which the temperature is temporarily decreased to lower than room temperature to reduce the retained austenite.

However, when toughness is considered, it was found that existence of a certain amount of the retained austenite in the stage after solution treatment and before aging treatment allows toughness to become better. The retained austenite content in the stage after solution treatment and before aging treatment may be approximately 0.1 to 5.0 volume %.

Then, during aging treatment performed after solution treatment, reverse-transformed austenite is sometimes generated in addition to the retained austenite, resulting in a slight increase in the austenite content. Therefore, in the present invention, taking the austenite content to be increased by aging treatment into consideration, the volume fraction of austenite is set to be 0.1 to 6.0%.

In the present invention, an austenite content of less than 0.1 volume % increases tensile strength and proof stress while lowering toughness. Thus, an absorption energy of 30 J or higher can be hardly attained. The presence of 0.1 volume % or more of austenite can be resulted in an improvement in toughness. By selecting heat treatment conditions, an absorption energy of approximately 30 J can be obtained. On the other hand, when the austenite content exceeds 6.0 volume %, while the absorption energy remains roughly unchanged, a tendency that strength gradually decreases can be observed. Therefore, the upper limit of the austenite content is set to be 6.0 volume %. The range of the austenite content that allows strength and an absorption energy to be balanced is 0.3 to 6.0 volume %.

Thus, the technical idea that austenite is actively remained or generated in the precipitation strengthening type stainless steel is a technical idea peculiar to the invention according to the present application which has not been found in, for example, the invention disclosed in Patent Document 1 described previously.

Here, the austenite content allowing good toughness and strength to be balanced after the above-described aging treatment is preferably within a range of 0.3 to 5.0 volume %. The lower limit of the austenite content is preferably 0.4 volume %, further preferably 1.0 volume %, and more preferably 2.0 volume %.

Also, in order to adjust to the above-described austenite content after aging, the lower limit of the retained austenite content in the stage after solution treatment and before aging treatment may be set to be preferably 0.3 volume %, and further preferably 1.0 volume %.

An example of specific heat treatment conditions for achieving the above-described austenite content will be mentioned. Solution treatment is performed at a temperature range of 800 to 950° C. for 1 to 4 hours. The upper limit of the solution treatment temperature is preferably 930° C., and more preferably 910° C. The lower limit of the solution treatment temperature is preferably 840° C., and more preferably 870° C. Aging treatment may be performed at a temperature range of 490 to 540° C. for more than 6 hours. A more preferred time of aging treatment is 8 to 12 hours. When the time of aging treatment is too short, formation of reverse-transformed austenite becomes insufficient, thereby failing to obtain sufficient toughness. Conversely, when the aging time is too long, strength significantly decreases. Also, in cooling of the heat treatment, air cooling, oil cooling, water cooling or the like can be selected to change a cooling speed. These conditions need to be selected according to retained austenite formation tendencies of alloys. In a case of alloy ingredients which contain Ni, Al or the like in a large amount and cause retained austenite to be formed in a large amount, sub-zero treatment may be performed to adjust the retained austenite content.

Next, reasons for selecting alloy elements and chemical ingredient ranges of the precipitation strengthening type martensitic steel according to the present invention will be described. Chemical ingredients are described in mass %.

C: 0.05% or Less

C is an element that improves quenching hardness and influences mechanical properties in low-alloy steels and the like. In contrast to this, in the present invention, C is an element that should be controlled as impurities. When C bonds to Cr to form a carbide, reduction of the Cr content in a matrix phase causes corrosion resistance to deteriorate. Furthermore, C is also likely to bond to Ti, to form a carbide. In this case, Ti which originally forms an intermetallic compound to contribute to precipitation strengthening becomes a carbide which less contributes to strengthening. Accordingly, strength properties deteriorate. Therefore, C is set to be 0.05% or less. The upper limit of C is preferably 0.04% or less. C is preferably as low as possible. However, during actual operations, at least approximately 0.001% of C is contained.

Si: 0.2% or Less

Si may be added as a deoxidizing element during manufacture. When Si exceeds 0.2%, an embrittled phase that decreases the strength of an alloy becomes likely to be precipitated. Thus, the upper limit of Si is set to be 0.2%. For example, when a deoxidizing element that replaces Si is added, Si may be 0%.

Mn: 0.4% or Less

Mn has a deoxidizing effect similarly to Si, and may be added during manufacture. When Mn exceeds 0.4%, forging properties at high temperature are worsened. Thus, the upper limit of Mn is set to be 0.4%. For example, when a deoxidizing element that replaces Mn is added, Mn may be 0%.

Ni: 7.5 to 11.0%

Ni is an element that bonds to Al described later or Ti to form an intermetallic compound contributing to strengthening and that is essential for improving the strength of an alloy. Also, Ni is solved in a matrix phase and has an effect of improving the toughness of an alloy. In order to form a precipitate while maintaining the toughness of a matrix phase by adding Ni, at least 7.5% or more of Ni is necessary. Ni also has effects of stabilizing an austenite phase and lowering a martensitic transformation temperature. Therefore, since excess addition of Ni causes martensitic transformation to become insufficient, the retained austenite content increases, and the strength of an alloy comes to decrease. Thus, the upper limit of Ni is set to be 11.0%. Here, for further ensuring the effects of Ni addition, the lower limit of Ni is set to be preferably 7.75%, and further preferably 8.0%. Also, the upper limit of Ni is preferably 10.5%, and further preferably 9.5%.

Cr: 10.5 to 13.5%

Cr is an element that is essential for improving the corrosion resistance and the oxidation resistance of an alloy. When Cr is less than 10.5%, the alloy cannot have sufficient corrosion resistance and oxidation resistance. Thus, the lower limit of Cr is set to be 10.5%. Also, Cr has an effect of lowering a martensitic transformation temperature, similarly to Ni. Excess addition of Cr causes increase of the retained austenite content and reduction in strength due to precipitation of a 8 ferrite phase. Accordingly, the upper limit of Cr is set to be 13.5%. Here, for further ensuring the effects of Cr addition, the lower limit of Cr is set to be preferably 11.0%, and further preferably 11.8%. Also, the upper limit of Cr is preferably 13.25%, and further preferably 13.0%.

Mo: 1.75 to 2.5%

Since Mo is solved in a matrix phase to contribute to the solid solution strengthening of a material as well as to the improvement of corrosion resistance, Mo is always added. Less than 1.75% of Mo makes the strength of a matrix phase with respect to that of a precipitation strengthening phase insufficient, causing a decrease in the ductility and the toughness of an alloy. On the other hand, when Mo is excessively added, the retained austenite content increases in association with a decrease in the martensitic transformation temperature, and a δ ferrite phase is precipitated. As a result, the strength decreases. Therefore, the upper limit of Mo is set to be 2.5%. Here, for further ensuring the effects of Mo addition, the lower limit of Mo is set to be preferably 1.9%, and further preferably 2.0%. Also, the upper limit of Mo is preferably 2.4%, and further preferably 2.3%.

Al: 0.9 to 2.0%

In the present invention, Al is an element that is essential for improving strength. Al bonds to Ni in aging treatment to form intermetallic compounds. These are finely precipitated in the martensite structure, thereby to provide high strength properties. In order to obtain the precipitated amount that is required for strengthening, 0.9% or more of Al is necessary to be added. On the other hand, excess addition of Al causes the precipitated amount of the intermetallic compounds to become excessive. As a result, the Ni content in a matrix phase decreases to reduce toughness. Therefore, the upper limit of Al is set to be 2.0%. Here, for further ensuring the effects of Al addition, the lower limit of Al is set to be preferably 1.0%, and further preferably 1.1%. Also, the upper limit of Al is preferably 1.7%, and further preferably 1.5%.

Ti: Less than 0.1%

Ti is, similarly to Al, an element that forms a precipitate to exert an effect of improving the strength of an alloy. However, Ti has a stronger tendency to form the retained austenite compared to Al. Therefore, excess addition of Ti causes a decrease in strength associated with the increase of the retained austenite to become larger. Therefore, Ti is set to be less than 0.1%. Also, when the strength of an alloy can be sufficiently improved by the previously described Al, Ti is not always necessary to be added, and Ti may be 0% (no addition).

Remainder of Fe and Impurities

The remainder is Fe, and impurity elements that are unavoidably mixed in during manufacture. Examples of representative impurity elements may include S, P and N. The amounts of these elements are desirably smaller. However, an amount to which each element can be decreased without problems during manufacture in common facilities may be 0.05% or less.

Here, particular ranges of the ingredients that allow strength and toughness to be balanced, within the ranges of the elements defined in the present invention described above, are in the range of 0.04 or less for C, 0.2% or less for Si, 0.4% or less for Mn, 8.2 to 8.5% for Ni, 12.5 to 13.0% for Cr, 2.0 to 2.3% for Mo, 1.2 to 1.5% for Al, and the remainder of Fe and impurities. By additionally appropriately controlling the austenite content, it is possible to obtain a tensile strength of 1530 MPa and an absorption energy of 40 J.

EXAMPLES

Example 1

The present invention will be described in detail by referring to the following examples.

Ten kg of a steel ingot was prepared by vacuum melting. Then, a forged material having a cross section of 45 mm×20 mm and a square timber shape was prepared by hot forging. The ingredients of the melted steel ingot are listed in Table 1.

TABLE 1

(mass %)

| No. | C | Si | Mn | Ni | Cr | Mo | Al | Ti | Remainder |
|---|---|---|---|---|---|---|---|---|---|
| 1 | 0.034 | 0.10 | 0.10 | 8.19 | 12.68 | 2.20 | 1.17 | — | Fe and unavoidable impurities |
| 2 | 0.038 | <0.01 | <0.01 | 8.10 | 12.67 | 2.24 | 1.30 | — | Fe and unavoidable impurities |
| 3 | 0.039 | <0.01 | 0.01 | 8.45 | 12.71 | 2.25 | 1.32 | — | Fe and unavoidable impurities |

TABLE 1-continued

| No. | C | Si | Mn | Ni | Cr | Mo | Al | Ti | Remainder (mass %) |
|---|---|---|---|---|---|---|---|---|---|
| 4 | 0.036 | <0.01 | 0.01 | 8.32 | 10.98 | 2.20 | 1.27 | — | Fe and unavoidable impurities |
| 5 | <0.010 | <0.01 | 0.01 | 11.61 | 11.02 | 1.02 | 0.46 | 1.03 | Fe and unavoidable impurities |

Note:
In the table, "—" indicates no addition.

The forged material was subjected to heat treatments with various conditions listed in Table 2. The solution treatment is 927° C.×1 hour retention followed by oil cooling. In some cases, a sub-zero treatment of −75° C.×2 hours was performed after the solution treatment for the purpose of reducing the retained austenite. Thereafter, an aging treatment of 524° C.×8 hours retention followed by air cooling was performed. The treated material was processed into a test piece, and subjected to characteristic evaluations. Tensile tests were performed in accordance with ASTM-E8. Charpy impact tests were performed using 2 mm V-notched test pieces. Austenite contents were measured using RINT2000 (x-ray source: Co) manufactured by Rigaku Corporation. With respect to combinations of (200), (220) and (311) planes of an austenite phase and each of (200) and (211) diffraction planes of a ferrite phase, austenite contents were calculated by a direct comparison method with integrated intensities and R values. Specifically, an averaged value of the volume fractions calculated according to formula (1) was defined to be the volume fraction of an austenite phase in the material.

In the formula (1), $V_\gamma$ means an austenite volume fraction, $I_\alpha$ means an integrated intensity of a diffraction peak of a ferrite phase, $I_\gamma$ means an integrated intensity of a diffraction peak of an austenite phase, and $R_\alpha$ and $R_\gamma$ mean a constant determined for each diffraction plane. As the R value, a value of an analysis program of an apparatus was used.

[Mathematical Formula 1]

$$V_\gamma = \frac{1}{(I_\alpha R_\gamma / I_\gamma R_\alpha) + 1} \quad (1)$$

In the present example, a tensile strength is used as an index of strength, and a Charpy absorption energy is used as an index of toughness. The aging treatment conditions, which were suitable for obtaining the respective balanced properties of a tensile strength of 1500 MPa and a Charpy absorption energy of 30 J, were heating at 524° C. for 8 hours and following by air-cooling. When the aging temperature was higher than it, there was a tendency that toughness improved while strength decreased. Conversely, when lower than it, there was a tendency that strength improved while toughness decreased.

Table 3 indicates tensile strengths obtained in the respective tensile tests and absorption energies obtained in the respective Charpy impact tests, the test being performed on 524° C. aging materials. The tests were respectively performed at room temperature.

TABLE 2

| Test No. | Alloy No. | Solution treatment | Sub-zero treatment | Aging treatment |
|---|---|---|---|---|
| 1 | 1 | 927° C. × 1 hour, oil cooling | No | 524° C. × 8 hours, air cooling |
| 2 | 1 | 927° C. × 1 hour, oil cooling | Yes | |
| 3 | 2 | 927° C. × 1 hour, oil cooling | No | |
| 4 | 3 | 927° C. × 1 hour, oil cooling | No | |
| 5 | 4 | 927° C. × 1 hour, oil cooling | No | |
| 11 | 2 | 927° C. × 1 hour, oil cooling | Yes | |
| 12 | 4 | 927° C. × 1 hour, oil cooling | Yes | |
| 13 | 5 | 840° C. × 2 hour, water cooling | Yes | |

Test Nos. 1 to 5 are examples of the present invention, and Test Nos. 11 to 13 are comparative examples.

Test No. 1 and No. 2 are both the results of Alloy No. 1. However, since sub-zero treatment was performed in Test No. 2, the austenite content is low both after solution treatment (ST) and after aging treatment (Ag). Therefore, while the tensile strength increases, the absorption energy decreases. Since Alloy No. 1 contains balanced alloy ingredients, the austenite content defined in the present invention was obtained regardless whether or not the sub-zero treatment was performed.

Test No. 3, Test No. 4 and Test No. 5 contain Al. Ni and Cr in different amounts from each other. All of them had good tensile strength and toughness. The austenite contents and these properties are not always in a proportional relation to each other. It is considered that this is because the precipitation amounts and the ingredients of matrix phases differ from each other due to the differences of alloy ingredients.

Test No. 11 and Test No. 12 were obtained by performing sub-zero treatment on Alloy No. 2 and Alloy No. 4. However, in these, unlike Test No. 2, the retained austenite phases disappear. Furthermore, the austenite contents are insufficient even after aging treatment. As a result, absorption energies decreased. In these alloys, there is a tendency that austenite is less easy to be formed compared to Alloy No. 1. That is, it is considered that the sub-zero treatment caused austenite to excessively decrease. In Test No. 3 and Test No. 5, which are alloys identical to these but were not subjected to the sub-zero treatment, good results were obtained with respect to both tensile strength and absorption energy. This indicates that even identical alloys cannot obtain strength and toughness in a balanced manner unless the austenite amount is appropriately controlled.

Test No. 13 is a test on Alloy No. 5. Compared to others. Ni and Ti are contained in a large amount that exceeds the ingredient range of the present invention. Therefore, even after the sub-zero treatment, the retained austenite content is as much as 7%. As a result, the strength fell below the targeted 1500 MPa.

Example 2

TABLE 3

| Test No. | Alloy No. | Austenite content (volume %) After (ST) | Austenite content (volume %) After (Ag) | Tensile strength (MPa) | Absorption energy (J) | Remark |
|---|---|---|---|---|---|---|
| 1 | 1 | 4.2 | 5.0 | 1510 | 46.1 | Present invention |
| 2 | 1 | 1.7 | 2.0 | 1531 | 33.7 | Present invention |
| 3 | 2 | 3.3 | 5.0 | 1510 | 36.0 | Present invention |
| 4 | 3 | 4.6 | 5.8 | 1533 | 40.7 | Present invention |
| 5 | 4 | 1.4 | 3.2 | 1516 | 46.2 | Present invention |
| 11 | 2 | 0.0 | 0.0 | 1597 | 21.8 | Comparative example |
| 12 | 4 | 0.0 | 0.0 | 1584 | 20.3 | Comparative example |
| 13 | 5 | 7.1 | 9.2 | 1473 | 43.0 | Comparative example |

An example in which manufacture in an actual product scale was performed using the precipitation strengthening type martensitic steel according to the present invention will be indicated.

One ton of a steel ingot manufactured by vacuum induction melting and vacuum are remelting was hot forged into a round bar having a diameter of 220 mm to obtain a material. The characteristic evaluation similar to in Example 1 was performed on a test piece taken from this material. The ingredients of the steel ingot obtained by vacuum are remelting are listed in Table 4.

Also, the heat treatment conditions were solution heat treatment in two conditions of 927° C.×1 hour retention followed by air cooling and 880° C.×1 hour retention followed by air cooling, a sub-zero treatment of −75° C.×2 hours, and an aging treatment of 524° C.×8 hours retention followed by air cooling.

The results of the characteristic evaluation are listed in Table 5. The austenite contents of the material subjected to the characteristic evaluation were 0.2% after the sub-zero treatment and 0.4% after the aging treatment in Test No. 21. Also, this austenite contents were 3.0 after the sub-zero treatment and 3.6% after the aging treatment in Test No. 22. All of these were within the range of the austenite content defined in the present invention. The tensile strengths exceeded the targeted 1500 MPa, and the Charpy absorption energies also exceeded 30 J. However, in the range of the present example, the results indicate that No. 22 obtained by solution heat treatment at 880° C. has more excellently balanced strength and toughness.

TABLE 4

| No. | C | Si | Mn | Ni | Cr | Mo | Al | Ti | Remainder |
|---|---|---|---|---|---|---|---|---|---|
| 21 | 0.029 | 0.02 | 0.02 | 8.20 | 12.75 | 2.20 | 1.20 | 0.003 | Fe and unavoidable impurities |

Note:
In the table, "—" indicates no addition.

TABLE 5

| Test No. | Alloy No. | Austenite content (volume %) After (Ag) | Tensile strength (MPa) | Absorption energy (J) | Remark |
|---|---|---|---|---|---|
| 21 | 21 | 0.4 | 1540 | 31.5 | Present invention |
| 22 | 21 | 3.6 | 1553 | 41.2 | Present invention |

FIG. 1 is a diagram illustrating the correlation between the tensile strength and the austenite content after aging, for each alloy described in Example 1 and Example 2. The diagram indicates a tendency that as the austenite content decreases, the tensile strength increases. In all of the tests in which the austenite contents were 6 volume % or less, tensile strengths exceeding 1500 MPa are obtained.

Figure 2:
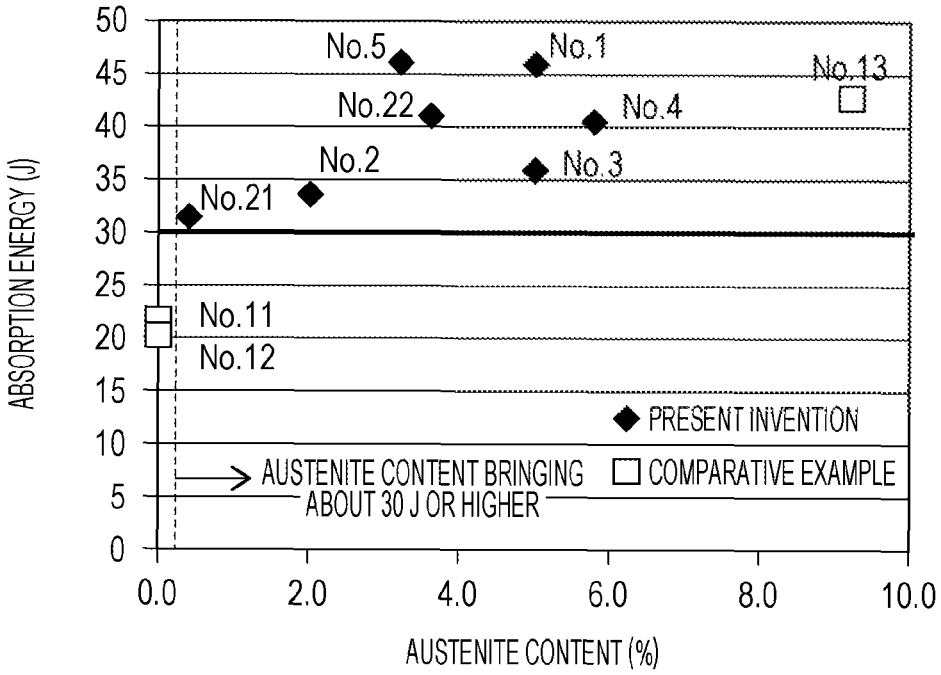
FIG. 2 is a diagram illustrating the correlation between an absorption energy and an austenite content.

FIG. 2 is a diagram illustrating the correlation between the absorption energy and the austenite content after aging. There is a tendency that as the austenite content decreases, the absorption energy decreases. Particularly, when the austenite content is around 0 volume %, the absorption energy rapidly decreases. The precipitate that contributes to strengthening is mainly precipitated in the martensite phase. As a result, the austenite phase is relatively easy to deform. Therefore, the existence of a large amount of the austenite phase leads to a decrease of the strength. However, it is considered that a small amount of the austenite phase has a role of absorbing impact energy to improve toughness.

Figure 3:
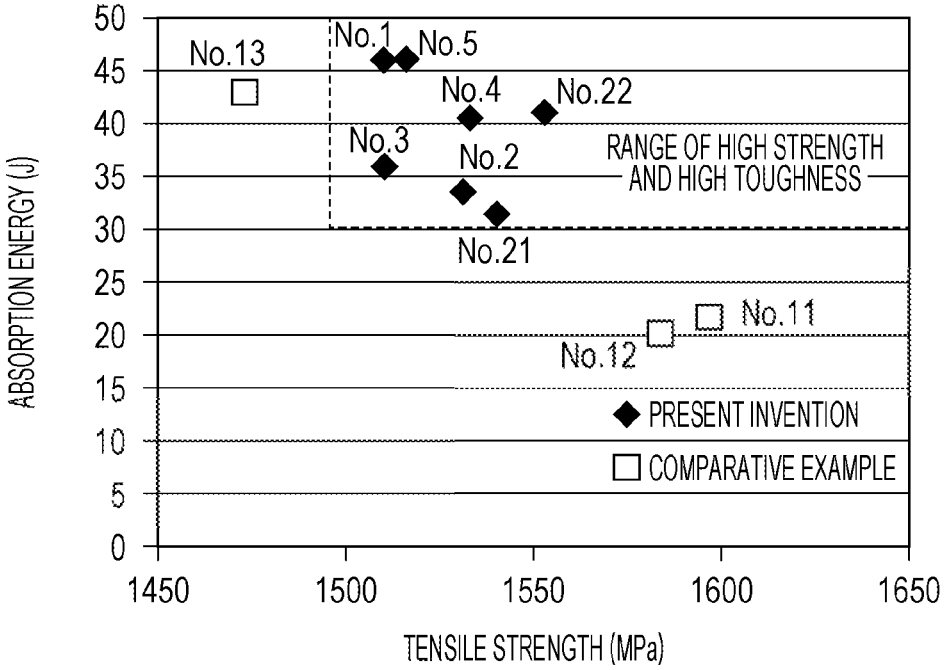
FIG. 3 is a diagram illustrating the correlation between a tensile strength and an absorption energy.

FIG. 3 is a diagram illustrating the correlation between the tensile strength and the absorption energy. A tendency is observed that as the tensile strength increases, the absorption energy decreases. By controlling the austenite content with appropriate ingredients and heat treatment, an alloy having both strength and toughness in a balanced manner can be obtained. Being located in the more upper right of the diagram indicates that the balance is favorable. In the present examples, Test No. 4 and No. 22 have an excellently balanced strength and toughness with a tensile strength of 1530 MPa or higher and an absorption energy of 40 J or higher.

From the above results, it is understood that the precipitation strengthening type martensitic steel according to the present invention has both high strength and excellent toughness. Therefore, when this is used in power generation turbine components, the efficiency can be expected to improve. Also, the use of this as aircraft components enables contribution to weight reduction of aircraft bodies.

The invention claimed is:

1. A process for producing a precipitation strengthening martensitic steel comprising, in terms of mass %, 0.05% or less of C, 0.2% or less of Si, 0.4% or less of Mn, 7.5 to 11.0% of Ni, 10.5 to 13.5% of Cr, 1.75 to 2.5% of Mo, 0.9 to 2.0% of Al, less than 0.1% of Ti, and a remainder of Fe and impurity elements, an amount of each impurity element being less than 0.05%, wherein solution treatment is performed at 800 to 950° C. followed by aging treatment performed on the precipitation strengthening martensitic steel containing 0.1 to 5.0% of austenite in terms of a volume fraction, to obtain the precipitation strengthening martensitic steel having an austenite volume fraction of 2.0 to 6.0%, a tensile strength of 1500 MPa or higher, and an absorption energy obtained by a Charpy impact test of 30 J or higher.

2. The process for producing the precipitation strengthening martensitic steel according to claim 1, wherein the aging treatment is performed at 490 to 540° C.

3. The process for producing the precipitation strengthening martensitic steel according to claim 1, wherein the aging treatment is performed for more than 6 hours.

4. The process for producing the precipitation strengthening martensitic steel according to claim 2, wherein the aging treatment is performed for more than 6 hours.

5. The process for producing the precipitation strengthening martensitic steel according to claim 1, wherein the solution treatment is performed, followed by the aging treatment performed on the precipitation strengthening martensitic steel containing 1.0 to 5.0% of austenite in terms of a volume fraction.

6. The process for producing the precipitation strengthening martensitic steel according to claim 2, wherein the solution treatment is performed, followed by the aging treatment performed on the precipitation strengthening martensitic steel containing 1.0 to 5.0% of austenite in terms of a volume fraction.

7. The process for producing the precipitation strengthening martensitic steel according to claim 3, wherein the solution treatment is performed, followed by the aging treatment performed on the precipitation strengthening martensitic steel containing 1.0 to 5.0% of austenite in terms of a volume fraction.

8. The process for producing the precipitation strengthening martensitic steel according to claim 4, wherein the solution treatment is performed, followed by the aging treatment performed on the precipitation strengthening martensitic steel containing 1.0 to 5.0% of austenite in terms of a volume fraction.

* * * * *